United States Patent [19]

Hinchcliffe et al.

[11] 4,397,457

[45] Aug. 9, 1983

[54] SHEET FEEDING APPARATUS

[75] Inventors: Dennis Hinchcliffe; Desmond W. Molins, both of London, England

[73] Assignee: Molins Limited, London, England

[21] Appl. No.: 268,926

[22] Filed: Jun. 1, 1981

[30] Foreign Application Priority Data

Jun. 11, 1980 [GB] United Kingdom ..... 8019121

[51] Int. Cl.[3] ..... B65H 3/08; B65H 1/14

[52] U.S. Cl. ..... 271/12; 271/30 R; 271/98; 271/154

[58] Field of Search ..... 131/280, 105; 271/98, 271/105, 103, 12, 30 R, 154, 150, 148

[56] References Cited

U.S. PATENT DOCUMENTS

| | | | |
|---|---|---|---|
| 924,637 | 6/1909 | Cox | 271/148 |
| 2,693,957 | 11/1954 | Welsh | 271/12 |
| 2,851,269 | 9/1958 | Zook | 271/148 |
| 3,902,713 | 9/1975 | Luhmann et al. | 271/154 |
| 3,938,800 | 2/1976 | Wirz | 271/98 |

*Primary Examiner*—V. Millin

*Attorney, Agent, or Firm*—John C. Smith, Jr.

[57] ABSTRACT

A stack of sheets, in particular hinged-lid blanks B for cigarette packets, are disposed in a vertical stack S from the top of which successive sheets are lifted by a suction member and removed by mechanical means, e.g. by a pair of conveyors 21 provided with pushers 23.

The suction member may be a gang of sleeves 14 to which suction is continuously supplied, so that when a sheet B is engaged by the sleeves they are lifted automatically by suction in readiness for the pushers 23 to remove the raised sheet B, after which the sleeves again drop by gravity. The stack S may be inched around a J-shaped stack, or lifted by a pair of divergent conveyors 30 to which replenishing groups of blanks G are fed from underneath.

7 Claims, 4 Drawing Figures

SHEET FEEDING APPARATUS

SHEET FEEDING APPARATUS

This invention relates to feeding of sheets from a stack, for example blanks which are to be formed into packets such as hinged-lid packets.

In machines for packing cigarettes in hinged-lid packets it is usual to have the supply of packet blanks held in a vertical stack and to remove the blanks singly from the bottom of the stack at the rate which packets are being formed. Commonly such removal is performed by a reciprocating plunger having rubber pads to which suction is selectively applied, the remaining blanks in the stack being held back by fixed ledges at the exit of the stack.

A fault which may often occur in such an arrangement is that either the plunger fails to remove the blank from the stack or, alternatively, that more than one blank is removed, which can cause serious disruption in the subsequent parts of the packing machine. It may be possible to remedy this fault for a while by adjusting the fixed ledges at the exit of the stack. However, a change in level of the stack or a change in the batch of blanks may frequently cause a recurrence of the fault, usually requiring further adjustment of the ledges.

A further disadvantage in the above arrangement is the noise caused especially at high speed, due to sudden release of the high suction from the suction pads; and also the flicking noise caused by the forceful removing of the blanks from the ledges.

According to this invention there is provided apparatus for removing sheets singly from a stack of sheets, in particular hinged-lid blanks for cigarette packets, comprising feed means for feeding the stack with its upper end exposed in an upward direction, a substantially vertically reciprocable suction member engageable with each successive topmost sheet at said upper end to lift the sheet clear of the other sheets in the stack, and withdrawal means for withdrawing each sheet transversely from the suction member while in its lifted position.

The means for feeding the stack may comprise a roller engageable with one side of the stack and a conveyor belt disposed along a semi-circular path and engageable with the other side of the stack of sheets, in such a manner that the stack is rotated about an angle of 180°, thus enabling further batches of sheets to be replenished above an inlet between the roller and the belt. Alternatively, the means for feeding may comprise a pair of conveyors disposed at opposite sides of the stack and having corresponding stack supporting members which are disengageable from the stack as the stack is fed upwards.

The suction member may comprise at least one vertically slidable sleeve and a source of suction in continuous communication with the sleeve, so that when the sleeve has been closed off by engagement with the topmost sheet the sleeve and sheet will be lifted by the suction, and when the sleeve has been reopened by transverse removal of the sheet by the withdrawal means the sleeve will again drop under the effect of gravity.

The invention will now be described, by way of example only, with reference to the accompanying drawings, in which.

Figure 1:
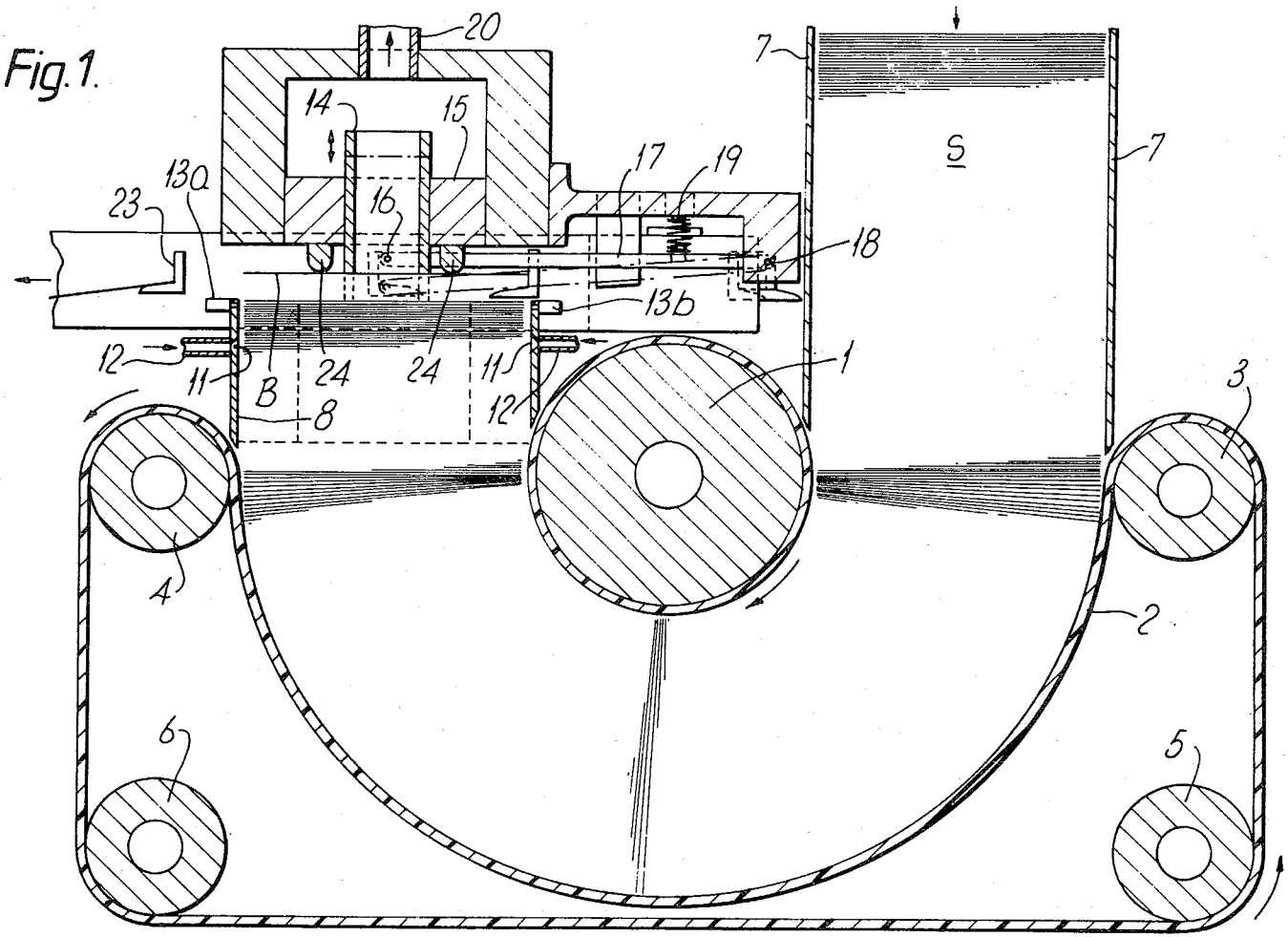
FIG. 1 is a side view of apparatus in accordance with the invention.

Referring first to FIG. 1, there is shown a stack of blanks S disposed in the shape of the letter J. Blanks are supplied periodically in bulk at the right-hand limb of the J, and are removed singly from the shorter left-hand limb. Between these limbs the blanks are rotated through an angle of 180° by means of an inner roller 1 and an outer conveyor belt 2 passing around fixed pulleys 3 and 4 and adjustable pulleys 5 and 6. In the longer supply limb the blanks are loosely constrained by guide walls 7, and they are then lightly compressed, by approximately 1 mm, between the roller 1 and the band 2, which are each provided with a compressible rubber surface. In the shorter outlet limb, to the left as viewed in FIG. 1, the blanks are again loosely constrained between walls 8.

An elongated slot 11 is formed in each of the walls 8 to which a source of compressed air is connected via air pipes 12. Immediately above the pipes 12 are a pair of photoelectric cells 13*a* and *b*, positioned at the outlet of the stack.

Figure 2:
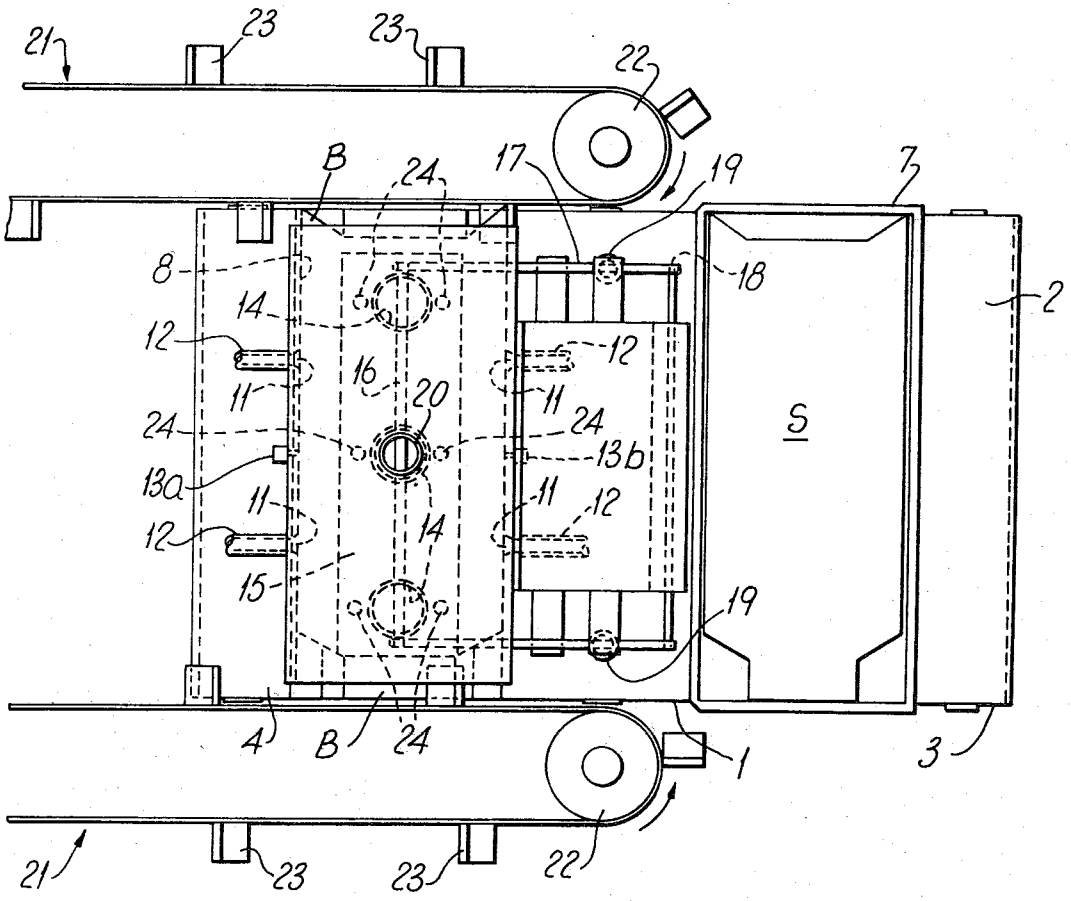
FIG. 2 is a plan view corresponding to FIG. 1, but drawn to a smaller scale.

Disposed above the top of the stack are three suction sleeves 14, best seen in FIG. 2. The sleeves 14 are vertically slidable in a housing 15 and are mechanically interconnected to a spindle 16 passing through each of the sleeves. The ends of the spindle 16 are mounted on a pair of arms 17, which are pivoted at 18 about a fixed structure and biased downwardly by a compression spring 19 acting on each arm 17.

Connected to the housing 15, and in communication with the sleeves 14, is a relatively large suction pipe 20 whose remote end is connected to a source of light vacuum, for example a fan.

Disposed at each side of the sleeves 14 is a conveyor 21 passing around the pulleys 22, and mounted on each conveyor are a series of equi-spaced pusher members 23 which are L-shaped, as viewed in FIG. 1.

In operation, with the arms 17 in their lower position (shown chain-dotted in FIG. 1), the continuous suction applied to the sleeves 14 causes the topmost blank B to adhere to the sleeves. As the bottoms of the sleeves 14 are now closed off by the blank B, atmospheric pressure acts on the underside of the blank to lift up the sleeves with the blank. Thus the arms 17 are raised against the bias of the springs 19, and the blank B is brought from the lower position to the upper position shown in FIG. 1 in full lines. The sleeves 14 continue to move slightly higher than the position shown, bringing the blank B into engagement with abutments 24 formed on the housing 15, so reducing the suction on the blank. The timing of the conveyor belt 21 is such that at this moment the pushers 23 come into engagement with the rear corners of the blank B and move it horizontally away from the sleeves 14 towards the left (beyond which the blank is folded and processed to form a packet, in a manner well known).

When the blank B has cleared the sleeves 14, they descend again by gravity and assisted by the action of the spring 19, and proceed to remove the next blank. After several blanks have been removed from the top of the stack the level of the stack will have dropped below a predetermined level sensed by the photoelectric cells 13*a* and *b*. The cell 13*a* is electrically connected to the drive for the belt 2, and the cell 13*b* is similarly connected to the drive for the roller 1; and when the cells sense that the level of blanks has fallen to this predetermined level, they respectively actuate the drives to the belt 2 and to the roller 1, causing the whole J-shaped stack to be inched around, thus restoring the level at the outlet of the stack to that shown in FIG. 1.

Compressed air to the pipes 12 may be supplied continuously in order to encourage separation of the blanks one from another.

Figure 3:
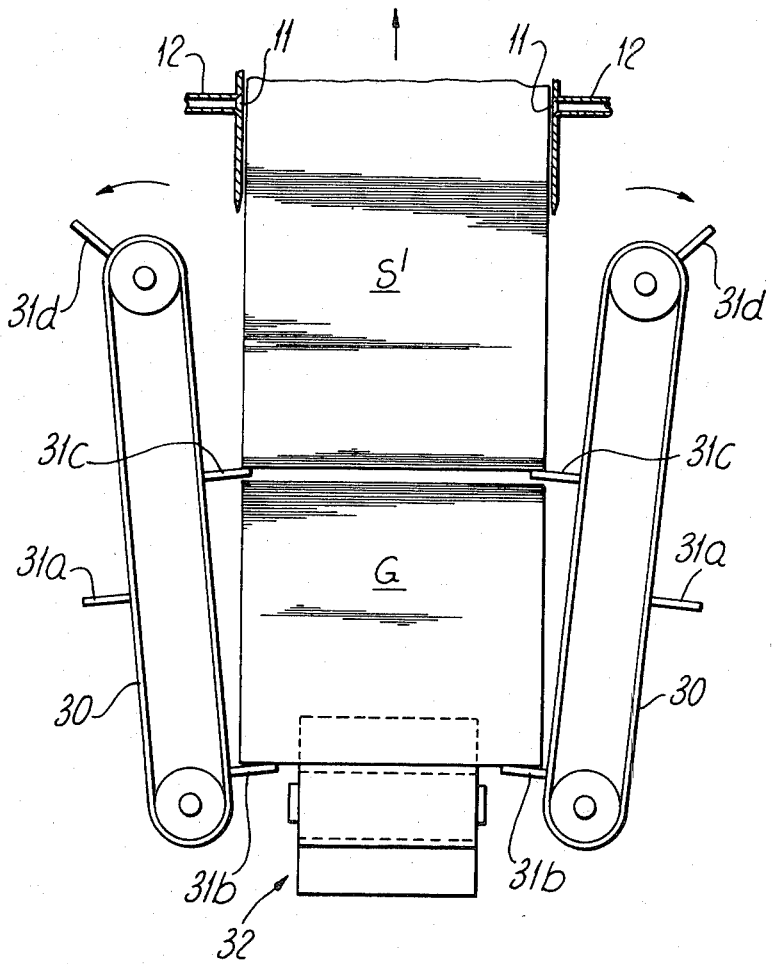
FIG. 3 is a side view of a modification of a part of FIG. 1.
Figure 4:
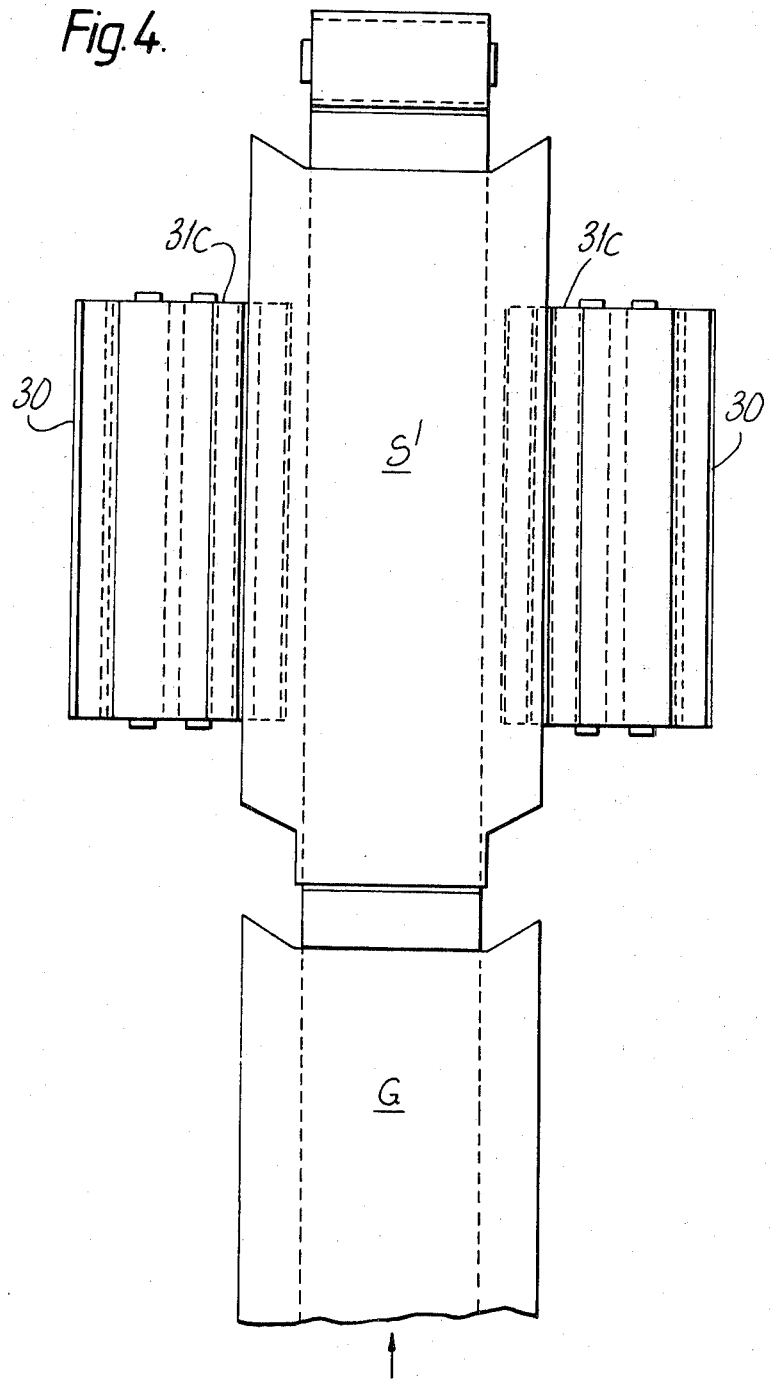
FIG. 4 is a plan view of the modification of FIG. 3.

Referring now to FIGS. 3 and 4, there is shown an alternative arrangement for inching the blanks upwards. In place of the roller 1 and belt 2, a pair of conveyors 30 are disposed at opposite sides of a stack S'. Mounted on each conveyor are four equi-spaced supporting lugs 31*a* to *d* which are in turn engageable with the bottom of the stack. The conveyors 30 diverge outwardly in an upward direction, so that as they intermittently inch the stack of blanks upwards each pair of supporting lugs (e.g. in the position shown, lugs 31*c*) progressively move away from the stack.

Disposed at right angles across and between the bottom ends of the conveyors 30 is a horizontal conveyor 32 on which are carried groups of blanks G of a predetermined height, slightly less than the spacing between adjacent lugs 31*a* to *d*. When a pair of lugs 31*b* are about to reach the position shown in FIG. 3 a new group of blanks G is fed by the conveyor 32 underneath the stack S' so that the lugs 31*b* are able to engage under it. As the lugs 31*b* carry the group G upwards, the lugs 31*c* in front move away from the stack S', which then drops a small amount on to the group G.

The indexing movement of the conveyor 32 may be geared to movement of the conveyors 30, so that as each pair of lugs reach the position of lugs 31*c* the conveyor 32 feeds the next group of blanks into position under the stack S'.

We claim:

1. Apparatus for removing sheets singly from a stack of a plurality of sheets, in particular hinged-lid blanks for cigarette packets; comprising feed means for feeding the stack with its upper end exposed in an upward direction, said feed means comprising a pair of conveyors disposed at opposite sides of said stack, each having a plurality of corresponding stack supporting members which are disengageable from said stack as said stack is fed upwardly; a substantially vertically reciprocable suction member engageable with each successive topmost sheet at said upper end to lift said sheet clear of the other sheets in said stack; and withdrawal means for withdrawing each sheet transversely from said suction member while in its lifted position.

2. Apparatus as claimed in claim 1 in which said withdrawal means comprises a pair of conveyors disposed at opposite sides of the suction member, a series of equi-spaced pusher members mounted on each conveyor, and means for driving the conveyors in timed relationship with movement of the suction member so that a pusher member from each conveyor engages and transversely withdraws a lifted sheet.

3. Apparatus as claimed in claim 1 further comprising replenishment means for feeding a group of sheets between adjacent stack supporting members under said stack.

4. Apparatus as claimed in any one of claims 1, 2 or 3 in which said suction member comprises at least one vertically slidable sleeve and a source of suction in continuous communication with the sleeve, so that when the sleeve has been closed off by engagement with the topmost sheet the sleeve and sheet will be lifted by the suction, and when the sleeve has been reopened by transverse removal of the sheet by the withdrawal means the sleeve will again drop under the effect of gravity.

5. Apparatus for removing sheets singly from a stack of a plurality of sheets, in particular hinged-lid blanks for cigarette packets, comprising feed means for feeding said stack along a substantially semicircular path terminating in an upward direction with the upper end of said stack at the terminal end of said path exposed in an upward direction; said feed means comprising a roller engageable with one side of said stack and a conveyor belt disposed along a substantially semicircular path parallel to said path of said stack and engageable with the side of said stack opposite said one side thereof to convey said stack about an angle of about 180° along said path; a substantially vertically reciprocable suction member engageable with each successive topmost sheet at said upper end to lift said sheet clear of the other sheets in said stack; and withdrawal means for withdrawing each sheet transversely from said suction member while in its lifted position.

6. Apparatus as claimed in claim 5 in which said withdrawal means comprises a pair of conveyors disposed at opposite sides of the suction member, a series of equi-spaced pusher members mounted on each conveyor, and means for driving the conveyors in timed relationship with movement of the suction member so that a pusher member from each conveyor engages and transversely withdraws a lifted sheet.

7. Apparatus as claimed in any one of claims 7 or 8 in which said suction member comprises at least one vertically slidable sleeve and a source of suction in continuous communication with the sleeve, so that when the sleeve has been closed off by engagement with the topmost sheet the sleeve and sheet will be lifted by the suction, and when the sleeve has been reopened by transverse removal of the sheet by the withdrawal means the sleeve will again drop under the effect of gravity.

* * * * *